US006030553A

United States Patent [19]

Huang et al.

[11] Patent Number: 6,030,553

[45] Date of Patent: Feb. 29, 2000

[54] POLYMER THICK FILM RESISTOR PASTES

[75] Inventors: Hui-min Huang, Changhua; Chia-Tin Chung, Miaoli Hsien; Bin-Yuan Lin, Hsinchu Hsien; Hsin-Herng Wang, Hsinchu; Wun-Ku Wang, Taipei; Te-Yeu Su, Hualien; Su-Jen Chang, Pingtung, all of Taiwan

[73] Assignee: Industrial Technology Research Institute, Hsinchu, Taiwan

[21] Appl. No.: 09/343,515

[22] Filed: Jun. 30, 1999

[30] Foreign Application Priority Data

Apr. 1, 1999 [TW] Taiwan ..... 88105219

[51] Int. Cl.[7] ..... H01B 1/06; H01B 1/04

[52] U.S. Cl. ..... 252/520.3; 252/503; 252/506; 252/511; 252/514; 252/519.32; 252/519.33; 29/610.1; 338/20

[58] Field of Search ..... 252/503, 506, 252/511, 514, 518.1, 519.32, 519.33, 520.3; 427/101–103; 29/610.1; 338/20

[56] References Cited

U.S. PATENT DOCUMENTS 5,863,847 1/1999 De Voe et al. ..... 442/151

5,962,608 10/1999 Ryang et al. ..... 526/89

*Primary Examiner*—Yogendra Gupta

*Assistant Examiner*—Derrick G Hamlin

*Attorney, Agent, or Firm*—Sughrue, Mion, Zinn, Macpeak & Seas, PLLC

[57] ABSTRACT

Polymer thick film resistor pastes with dimensionally stability and excellent processibility, such as coating, printing, and extruding, are disclosed. The resistor paste composition in accordance with the present invention comprises a low-k cycloaliphatic epoxy resin vehicle loaded with electrically conductive particles, a cationic photoinitiator, a thermal catalyst, and optionally a reactive diluent.

11 Claims, No Drawings

POLYMER THICK FILM RESISTOR PASTES

BACKGROUND OF THE INVENTION

1. Field of the Invention

The present invention relates in general to polymer thick film compositions. More particularly, it relates to solventless, UV hardenable, thermally curable resistor paste compositions.

2. Description of the Related Arts

Typically, polymer thick film resistor pastes contain conductive particles dispersed in a resin formulation. The uncured resistor paste is usually screen-printed or extruded through a syringe-like apparatus in the desired circuit pattern. The resistor paste is then cured by application of heat or UV radiation.

To achieve the desired low viscosity necessary for processing, conventional polymer thick film resistor pastes contain solvents to reduce viscosity. However, the conventional solvent based pastes may shrink up to 50% on curing due to solvent evaporation. This dimensional instability creates an uneven surface in the resistor pattern and cracks in the conductive fillers. Furthermore, contacts with metal electrodes may be broken as the shrinking volume pulls the resistor pattern away from the electrodes, thus creating electrical shorts.

One difficulty in developing UV curable resistor pastes is that the conductive fillers, such as carbon black or silver particles, do not transmit UV radiation. As a result, the interior regions of the resistor pattern are shielded from UV radiation and cannot be completely cured in the UV radiation step. In the case of thermally curable resistor pastes, shapes of the uncured resistor patterns are liable to distort during transportation, or due to variations of curing temperature. Thus, it is difficult to produce resistor patterns without deformation.

Most commercially available UV curable resins are inadequate for circuit writing application. For example, UV cured acrylates have poor adhesion to metals. Also, UV cure of acrylates is oxygen inhibited, resulting in a tacky surface due to incomplete curing. Further, silver (which is the standard conductive filler material) may catalyze polymerization of many formulations at room temperature before exposure to UV radiation. Once polymerized, these acrylate formulations cannot be used to write circuit patterns.

SUMMARY OF THE INVENTION

Accordingly, it is an object of the invention to solve the aforementioned problems and provide a thick film resistor paste composition having improved processibility, such as coating, printing, and extruding.

The above object is achieved by providing a solventless, UV hardenable, thermally curable resistor paste composition, which comprises (a) 100 parts by weight of a cycloaliphatic epoxy resin; (b) 1–10 parts by weight of a cationic photoinitiator; (c) 1–5 parts by weight of a thermal cure catalyst; (d) 1–90 parts by weight of electrically conductive particles, and optionally (e) 1–20 parts by weight of a reactive diluent.

According to a feature of the invention, the resistor paste composition includes a photoinitiator for triggering preliminary UV hardening and a thermal cure initiator for triggering heat curing of the polymeric resistor composition. In accordance with the invention, UV curing allows surface hardening of the resistor pattern to prevent deformation, while heat curing allows full curing of the resistor pattern.

According to another feature of the invention, the solventless formulation eliminates the dimensional stability problems caused by solvent evaporation. The resistor paste composition may include a reactive diluent to decrease the viscosity, if necessary. The reactive diluent which does not evaporate and is hardened during thermal curing, substantially retaining the resistor shape through the curing process.

According to a further feature of the invention, the cycloaliphatic resin formulation eliminates the cross talk problems which occur in an aromatic resin formulation.

Accordingly, the resistor paste in accordance with the present invention is particular suitable for applications of high frequency devices.

DETAILED DESCRIPTION OF THE INVENTION

In accordance with the present invention, a low-k, moisture resistant cycloaliphatic epoxy resin is employed as an organic vehicle for loading electrically conductive particles. The cycloaliphatic epoxy resin has the formula R—M—R', where M is —CO—O—$CH_2$— or —$CH_2$—O—CO—$C_4H_8$—CO—O—$CH_2$—, and each of R and R', independently, is cyclohexyl epoxide, methylcyclohexyl epoxide, or ethyl epoxide, provided that at least one of R and R' is cyclohexyl epoxide or methylcyclohexyl epoxide.

The photoinitiators included in the composition of the present invention initiate polymerization of the cycloaliphatic epoxy resin on exposure to UV radiation. Photoinitiators suitable for use in the present invention are onoium salts or organometallic salts, such as triarylsulfonium salts, diaryliodonium salts, aryldiazonium salts, triarylselenonium salts, dialkylphenacylsulphonium salts, triarylsulphoxonium salts, aryloxydiarylsulphoxonium salts, dialkylphenacylsulphoxonium salts, and iron arene complexes. Illustrative examples of such photoinitiators are triarylsulfonium hexafluorophophate salts, triarylsulfonium hexafluoroantimonate salts, and the like. The amount of the photoinitiator is preferably less than 10 parts by weight, since an excess of photoinitiator decreases the glass transition temperature (Tg) of epoxy resins (a decrease of 40° C. was observed when 10 parts by weight of a photoinitiator was added). Typically, UV curing affects only the surface of the resist pattern due to the shielding of conductive particle fillers. The remainder of the resin formulation is subsequently cured by heat. For this purpose, the resistor paste composition includes a thermal cure catalyst.

Thermal cure catalysts suitable for use in the invention include Louis acids, Bronsted acids, trifliz acids, metal cation salts, organic titanates, boron triflouride amine complexes, and onoium salts such as quaternary ammonium salts, sulfonium salts, phosphonium salts, and iodonium salts. The quaternary aimmonium salts include N,N-dimethyl-N-benzylanilinium hexafluoroantimonatc, N,N-dimethyl-N-benzylanilinium tetrafluoroborate, N,N-dimethyl-N-benzylpyridinium hexafluoroantimonate, N,N-diethyl-N-benzylpyridinium hexafluoroantimonate, N,N-diethyl-N-(4-methoxybenzyl)pyridinium hexafluoroantimonate, N,N-diethyl-N-(4-methoxybenzyl) toludinium hexafluoroantimonate. The sulfonium salts include triphenylsulfoniuim tetrafluorotorate, triphenylsulfonium hexafluoroantimonate, triphenylsulfonium hexafluoroarsenate, tri(4-methoxyphenyl) sulfonium hexafluoroarsenate, diphenyl(4-phenylthiophenyl) sulfonium hexafluoroarsenate. The phosphonium salts include ethyltriphenylphosphonium hexafluoroantimonate, and tetrabutyl hexafluoroantimonate. The iodonium salts include diphenyliodonium hexafluoroarsenate, di-4-chlorophenyliodonium hexafluoroarsenate, di-4-5 bromophenyliodonium hcxafluoroarsenate, di-p-triiodonium hexafluoroarsenate, and phenyl-(4-methoxyphenyl) iodonium hexafluoroarsenate. Illustrative of commercially available thermal cure catalysts useful in the present invention are Octant and RTM manufactured by General FiEilectric, FC 520 manufactured by 3M, Adeka CP-66 and CP-77 manufactured by Asahi Denka Kogyo, and $BF_3$-MEA.

Electrically conductive particles suitable for use in the invention can be conductive carbon black particles, silver particles, silver flakes, or mixtures thereof. The carbon black particles preferably have an average diameter ranging from 0.5 nm to 50 nm, and the silver particles preferably have an average diameter ranging from 0.1 $\mu$m to 20 $\mu$m. The resistivity of resistor patterns can be modulated by varying the amounts of electrically conductive particles.

The dispersibility of conductive particles in the cycloaliphatic epoxy resin can be improved by pre-treating the conductive particles with a coupling agent and/or a binder (i.e., a low-molecular-weight, water-soluble polymer). The pre-treatment can be achieved by simply agitating the conductive particles with the coupling agent and/or binder in an appropriate proportion- Accordingly, the resistor paste composition of this invention may further include 0.1–1 parts by weight of a coupling agent, and/or 0.01–10 parts by weight of a binder. Coupling agents to be used herein are preferably silane coupling agents having one or more epoxy groups. Illustrative of such a coupling agent is KBU available from Shin Etsu. Illustrative of binders suitable for use in the present invention are polyvinyl acetate (PVAc), polyethylene glycol (PEG), polyethylene oxide (PEO), and ethylene/vinyl alcohol copolymer (FVOH).

As already stated, the viscosity of the resistor paste can be decreased by adding a reactive, low viscosity diluent, rather than a solvent as is typically done in conventional resistor paste materials. A low viscosity required for processing can be achieved without causing problems associated with dimensional instability, such as cracking, electrical shorting, and surface unevenness. Preferably, the reactive diluent has a viscosity in the range of 0.1–20 cP, and suitable reactive diluents are vinyl ether such as is ERL-4206 available from Union Carbide Corporation (U.C.C.) or a low viscosity epoxy resin having one or two epoxy groups.

Without intending to limit it in any manner, the present invention will be further illustrated by the following examples.

EXAMPLE 1

A polymer thick film resistor paste having the components (and their parts by weight) listed in Table 1 below, was prepared as follows. At the outset, a resin mixture was first prepared at room temperature by mixing the cycloaliphatic epoxy resin, photoinitiator, thermal cure catalyst, and reactive diluent. In a kneader the resin mixture was then blended with carbon black particles which had been pro-treated by a binder and a coupling agent. The resulting resistor paste was screen printed onto a substrate provided with metal electrodes. The uncured resistor pattern was first exposed to UV radiation (400 w/in) for surface hardening, and then subjected to heating at 120° C. for one hour and 200° C. for another hour for full curing. The resulting resistor exhibited a volume resistivity of 24 ohm-cm at room temperature.

TABLE 1

| INGREDIENTS | AMOUNT (PARTS BY WEIGHT) |
|---|---|
| Cycloaliphatic epoxy resin (ERL-4221, U.C.C) | 95 |
| Photoinitiator (CYRACURE UVI-6974, U.C.C) | 1.5 |
| Thermal cure catalyst (ANCHOR 1040, Anchor chemical) | 3 |
| Carbon black (BLACK PEARLS 2000, Cabot) | 30 |
| Binder (PEG 4000, Merck) | 3 |
| Coupling agent (KBM 403, Shin Etsu) | 0.3 |
| Reactive diluent (EX-211, Nagase Chemicals) | 5 |

EXAMPLE 2

A polymer thick film resistor paste having the components (and their parts by weight) listed in Table 2 below, was prepared as follows. A resin mixture was first prepared at room temperature by mixing the cycloaliphatic epoxy resin, photoinitiator, thermal cure catalyst, and reactive diluent. In a kneader the resin mixture was then blended with carbon black particles and silver particles, both of which had been pre-treated by a binder and a coupling agent. The resistor paste thus produced was screen printed onto a substrate provided with metal electrodes. The uncured resistor pattern was exposed to UV radiation to for surface hardening, and then heated for full curing. The resulting resistor exhibited a volume resistivity of 4 ohm-cm at room temperature.

TABLE 2

| INGREDIENTS | AMOUNT (PARTS BY WEIGHT) |
|---|---|
| Cycloaliphatic epoxy resin (ERL-4221, U.C.C) | 95 |
| Photoinitiator (CYRACURE UVI-6974, U.C.C) | 1.5 |
| Thermal cure catalyst (ANCHOR 1040, Anchor chemical) | 3 |
| Carbon black (BLACK PEARLS 2000, Cabot) | 30 |
| Binder (PEG 4000, Merck) | 3 |
| Coupling agent (KBM 403, Shin Etsu) | 0.3 |
| Silver particles (EPI 101, EPI Industries) | 10 |
| Reactive diluent (EX-211, Nagase Chemicals) | 5 |

While the invention has been particularly shown and described with the reference to the preferred embodiment thereof, it will be understood by those skilled in the art that various changes in form and details may be made without departing from the spirit and scope of the invention.

What is claimed is:

1. A resistor paste composition comprising:

100 parts by weight of a cycloaliphatic epoxy resin;

1–10 parts by weight of a cationic photoinitiator,

1–5 parts by weight of a thermal cure catalyst; and

1–90 parts by weight of electrically conductive particles; wherein said electrically conductive particles are silver flakes or silver particles with an average diameter ranging from 0.1 $\mu$m to 20 $\mu$m.

2. The resistor paste composition as claimed in claim 1, wherein said cycloaliphatic epoxy resin has the formula R—M—R', where M is —CO—O—$CH_2$— or —$CH_2$—O—CO—$C_4H_8$—CO—O—$CH_2$—, and each of R and R', independently, is cyclohexyl epoxide, methylcyclohexyl epoxide, or ethyl epoxide, provided that at least one of R and R' is cyclohexyl epoxide or methylcyclohexyl epoxide.

3. The resistor paste composition as claimed in claim 1, wherein said cationic photoinitiator is selected from the group consisting of onoium salts and organometallic salts.

4. The resistor paste composition as claimed in claim 1, wherein said thermal cure catalyst is selected from the group consisting of Louis acids, Bronsted acids, trifliz acids, metal cation salts, organic titanates, boron triflouride amine complexes, and onoium salts.

5. The resistor paste composition as claimed in claim 1, wherein said electrically conductive particles are carbon black particles with an average diameter ranging from 0.5 nm to 50 nm.

6. The resistor paste composition as claimed in claim 1, further comprising 1–20 parts by weight of a reactive diluent.

7. The resistor paste composition as claimed in claim 6, wherein said reactive diluent is an epoxy resin having one or two epoxy groups or a vinyl ether, and has a viscosity ranging from 0.1 cP to 20 cP.

8. The resistor paste composition as claimed in claim 1, further comprising 0.01–10 parts by weight of a binder.

9. The resistor paste composition as claimed in claim 8, wherein said binder is selected from the group consisting of polyvinyl acetate, polyethylene glycol, polyethylene oxide, and ethylene/vinyl alcohol copolymer.

10. The resistor paste composition as claimed in claim 1, further comprising 0.01–1 parts by weight of a coupling agent.

11. The resistor paste composition as claimed in claim 10, wherein said binder is a silane coupling agent having one or more epoxy groups.

* * * * *